US005873433A

United States Patent [19]

Katz

[11] Patent Number: 5,873,433

[45] Date of Patent: Feb. 23, 1999

[54] STEP LADDER TRAY

[76] Inventor: Gary Edward Katz, 623 W. Guadalupe #278, Mesa, Ariz. 85210

[21] Appl. No.: 709,646

[22] Filed: Sep. 9, 1996

[51] Int. Cl.[6] ..... E04G 1/00

[52] U.S. Cl. ..... 182/129; 248/210; 248/238

[58] Field of Search ..... 182/129; 248/210, 248/238

[56] References Cited

U.S. PATENT DOCUMENTS

| | | | |
|---|---|---|---|
| 2,470,053 | 5/1949 | Salisbury | 182/129 X |
| 2,957,542 | 10/1960 | Rizzuto | 182/129 |
| 3,422,923 | 1/1969 | Lund | 182/129 X |
| 3,637,046 | 1/1972 | Emmons | 182/129 X |
| 3,842,936 | 10/1974 | DeLuca | 182/129 |
| 4,121,692 | 10/1978 | Morawski | 182/129 |
| 4,236,599 | 12/1980 | Luff et al. | 182/129 X |
| 4,261,435 | 4/1981 | Winter | 182/129 |
| 4,276,955 | 7/1981 | Hickman | 182/129 X |
| 4,418,793 | 12/1983 | Brent | 182/129 |
| 4,569,449 | 2/1986 | Brent | 182/129 X |
| 4,979,590 | 12/1990 | Bailey | 182/129 X |

*Primary Examiner*—Daniel P. Stodola
*Assistant Examiner*—Richard M. Smith
*Attorney, Agent, or Firm*—Gregory J. Nelson

[57] ABSTRACT

An accessory securable to the top cap of a step ladder for temporary storage of tools, parts and the like. The accessory includes a support which is securable to the top cap by various clamping arrangements which may include bolts, springs or tie downs. A tray member is pivotally attached to the support and in a deployed position extends horizontally forwardly. In a folded or storage position, the tray member is in overlying registry with the top cap of the ladder. In an alternate embodiment, the support is adjustable to accommodate step ladder caps of varying dimensions.

6 Claims, 5 Drawing Sheets

STEP LADDER TRAY

RELATED PROVISIONAL APPLICATION

BACKGROUND OF THE INVENTION

FIELD OF THE INVENTION

The present invention relates to a ladder accessory and more particularly relates to an article tray which is securable to the top cap of a step ladder for convenient storage and to provide access to stored tools, parts, paint containers and the like.

BACKGROUND OF THE INVENTION

When working from a step ladder, it is convenient to have tools, paint cans and other items readily accessible in a location where they can be retrieved and replaced allowing the worker free use of both hands when working. Because of this need, there are various trays in the prior art which are integrally attached to or are securable to a ladder for supporting tools and other articles. The most common of devices of this type is the conventional foldable tray or platform attached to the front support legs of a ladder and which may be pivoted to an out-of-the-way position when not in use and when the ladder is stored. Other ladder trays or article holders attachable to a ladder can be found in the prior art.

For example, U.S. Pat. No. 4,261,435 shows a tray with a clip and wire frame support for secure mounting on the top of a step ladder. The tray is shaped to hold tools and has small pockets for containment of small items.

U.S. Pat. No. 5,501,753 shows a paint can holder with a collar which suspends a paint can to facilitate painting directly from the can. The device is attached or supported from the top of a step ladder.

U.S. Pat. No. 3,991,961 shows a mounting bracket which carries a pivot which, in turn, supports a holder such as a collapsible bag. The device is not specifically for use with a ladder and may be attached to a window sill or ledge to assist in such tasks as washing windows. When not in use, the holder may be rotated so that it may be positioned out of the way.

U.S. Pat. No. 4,300,740 shows a movable shelf for a step ladder. The shelf has a pair of brackets which, for example, may engage the edge and underside of either a step or the top ledge of a ladder. Stop members in the form of pins may be engaged to prevent the shelf from sliding when in place.

U.S. Pat. No. 2,444,096 shows a paint receptacle for use with roller-type applicators having a tray which is supported by a foot which engages the top of the step ladder.

U.S. Pat. No. 4,460,063 shows a step ladder work bench which is hingedly attached to a step ladder, allowing it to be raised and hooked in place for use and lowered against the step ladder rails for storage.

While the foregoing show various types of clamps and supports for tools, some of which are adaptable for use with step ladders, these devices generally are designed so that they project from the step ladder when not in use, making storage of the ladder when it is folded or collapsed more difficult.

It is therefore a principal object of the present invention to provide a step ladder tray which is easier and more convenient for the worker to use.

Another object of the present invention is to provide a ladder-mounted convenience tray for receiving tools, articles and even paint cans, which tray may be folded to an out-of-the-way position overlying the top cap of the step ladder.

Another object of the present invention is to provide an article-receiving tray attachable to a step ladder which provides a user-convenient receptacle for tools, paints and other articles and which allows the user the free use of both hands when performing tasks.

Another object of the present invention is to provide a ladder tray which has a universal mounting so that it may be accommodated on most step ladders of conventional size.

BRIEF SUMMARY OF THE INVENTION

Briefly, the present invention provides a ladder tray which has a support member which is securable to the top cap of a step ladder. The support includes a plate or bracket which may be secured to the ladder cap by various clamping arrangements including bolts, springs or tie-downs. The forward edge of the support extends along the forward edge of the cap and carries a hinge to which a tray member is attached. When the tray member is in the deployed or use-position, it extends generally horizontally forwardly from the front legs or rails of the step ladder and preferably either abuts the front rails or has a flange or other member which abuts a projecting portion of the support to stabilize the tray. The tray may be conveniently dimensioned to receive work articles such as tools, screws, nails and may even include recesses or depressions for these articles and for containers such as paint cans of various sizes. When not in use, the tray may be folded to a stored position in which position the interior of the bottom of the tray abuts the support in overlying registry with the top cap of the ladder so that the tray is in a convenient out-of-the-way position.

In other embodiments, the width of the support may be laterally adjustable to accommodate top ladder caps of various widths. Other mounting arrangements may also be utilized such as elasticized or bungee-type cords which secure the ladder mounting base to the top cap of the ladder.

BRIEF DESCRIPTION OF THE DRAWINGS

The above and other objects and advantages of the present invention will be more fully understood and appreciated from the following specification, claims and drawings in which:

DETAILED DESCRIPTION OF THE DRAWINGS

Figure 1:
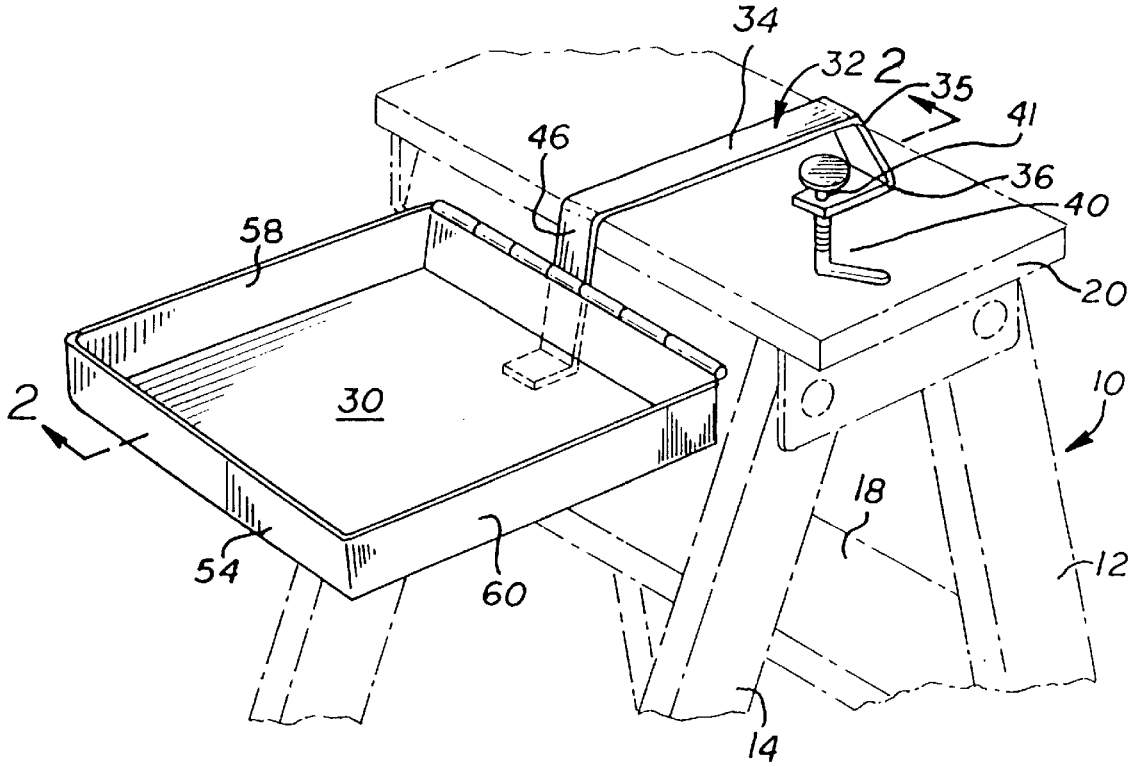
FIG. 1 is a perspective view of the top portion of the step ladder showing the article tray of the present invention attached thereto in a deployed position.
Figure 2:
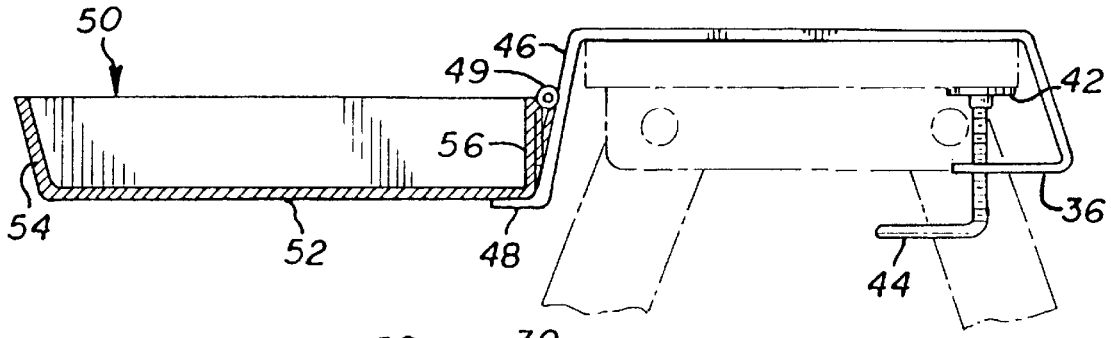
FIG. 2 is a side elevational view, partly in section, showing the tray of the present invention attached to the top cap of a step ladder in a deployed position.
Figure 3:
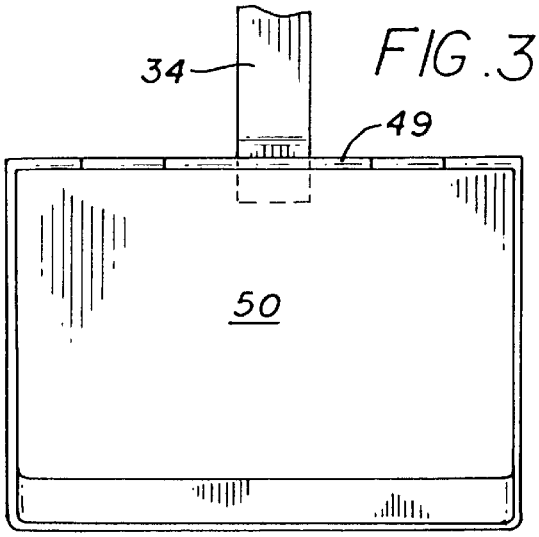
FIG. 3 is a top view of the article tray of the present invention.

Turning now to the drawings, particularly FIGS. 1 to 3, a conventional step ladder 10 is shown having rear legs 12 and forward legs or rails 14. As is conventional, the rear legs 12 are secured to a cap 20 at their upper ends and the front legs 14 are pivotally secured to the cap 20 so that the ladder may be folded for convenience of storage. The ladder is provided with a plurality of steps depending upon its height, one step 18 being shown. The top cap 20 is generally planar and rectangular and may be of varying dimensions depending upon the specifications of the manufacturer of the ladder. Safety practice cautions that the top cap should not be used a support surface on which the user stands, therefore the top cap provides a good location for attachment of the ladder tray 30.

The ladder tray 30 includes a support 32 which has a strap portion 34 which extends transversely across the cap of the ladder. The strap has a bight portion 35 that extends generally vertically around the edge of the top cap. A leg 36 projects forwardly from the bight 34 beneath the edge of the cap. A clamp 40 has a body which is in threaded engagement with a bore 41 in the leg 36. The clamp 40 may be axially adjusted to bring the head 42 into clamping engagement with the underside of the top cap. Rotation of the clamp is facilitated by the L-shaped handle 44.

Figure 2A:
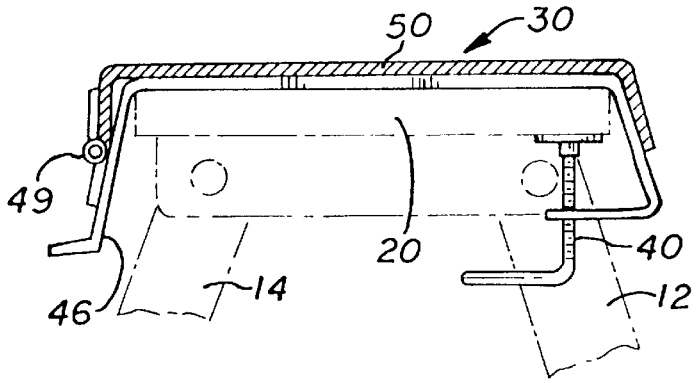
FIG. 2A is a view similar to FIG. 2 showing the tray in a stored position.

The support also includes a downwardly extending flange portion 46 which depends along the front edge of the ladder cap. The flange terminates at a forwardly turned lip 48. Spaced at an intermediate location along the flange is a hinge 49 which is also secured to the rear edge of tray member 50. The tray member 50 may be any convenient shape but is shown as being generally rectangular having a bottom 52, front wall 54, rear wall 56 and opposite side walls 58 and 60. The tray member 50 is open for receipt of articles and tools. The tray member 50 is dimensioned so that it has a width and length to allow it to be placed in an inverted, nested position overlying the top cap when in the stored position shown in dotted in FIG. 2A. This allows the tray to be easily deployed to the use-position or folded to the stored position in which it is out of the way for convenience when the ladder is stored or when use of the tray is not required. The tray may be made of any suitable material such as a rigid plastic or a suitable metal such as aluminum or light gauge sheet metal. In the latter case, the tray may be formed by stamping techniques and painted or powder coated for appearance and protection.

Figure 4:
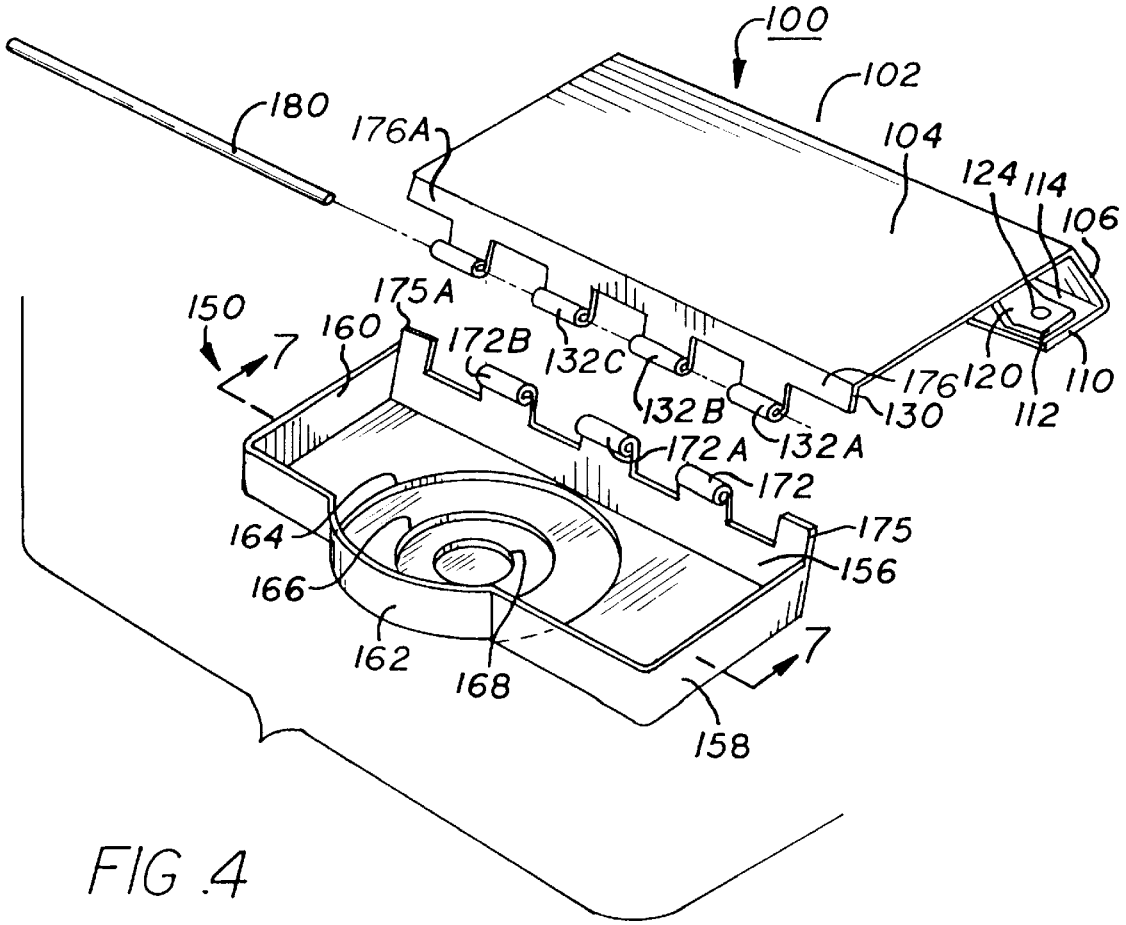
FIG. 4 is an exploded perspective view of another embodiment of the article tray of the present invention.
Figure 5:
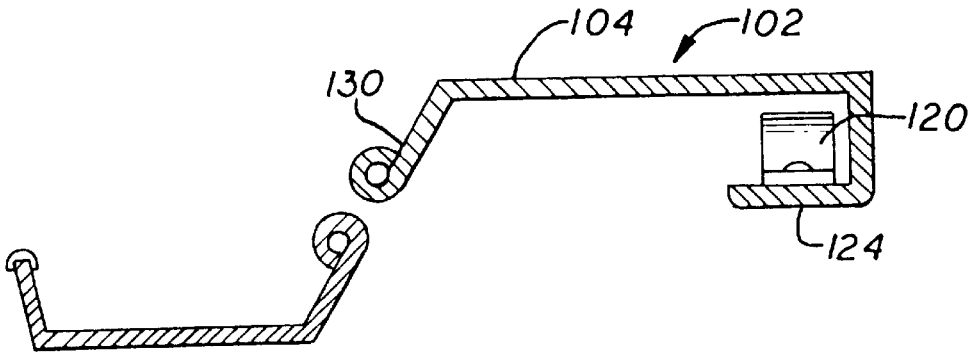
FIG. 5 is a cross-sectional view of the article tray of FIG. 4.
Figure 6:
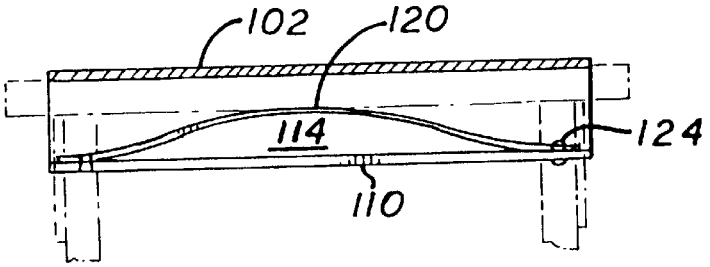
FIG. 6 is a sectional view taken along line 6—6 of FIG. 4.

FIGS. 4, 5 and 6 illustrate an alternate embodiment of the present invention generally designated by the numeral 100. In this embodiment, the support 102 has a generally planar top 104 which, when placed on the ladder, lies over the top of the top cap. The support 102 preferably has a width which extends beyond the edges of the top cap. The support is provided with a downwardly depending edge 106 which is formed having an inwardly turned section 110 and an upwardly turned lip 112 forming a transversely extending channel 114. A leaf spring 120 having a general arcuate shape is positioned in the channel and has one end secured to the section 110 by a fastener such as a rivet 124. This allows the opposite end of the leaf spring at least longitudinal movement within the channel. Thus, the support 102 can be secured to the top cap by compressing spring 120 sufficiently so that it engages the underside of the top cap exerting a biasing spring force against the underside of the top cap.

The forward end of the top 104 supports a downwardly and outwardly, angularly inclined lip 130 which is provided with a plurality of axially aligned, spaced-apart hinge barrels 132, 132A and 132B.

The tray member 150 is again shown as being generally rectangular having bottom wall 152, front wall 154, rear wall 156 and opposite side walls 158 and 160. The tray member is shown has having an arcuate projection 162 in front wall 154 to accommodate larger articles such as one gallon paint containers. A plurality of concentric depressions 164, 166 and 168 are formed in the bottom 152. The depressions are of increasing depth so that a small container such as a one pint paint container may be received within depression 168. Depressions 166 and 164 are to accommodate larger containers such as quart and gallon paint cans, respectively.

The rear wall 156 is provided with a plurality of cylindrical barrels 172, 172A and 172B. These barrels are engageable between the barrels 132 to 132B on the support so that a hinge pin 180 may be inserted so that the tray is pivotally mounted with respect to the base or support. Upwardly projecting flanges 175, 175A are provided at opposite edges of the rear wall 156 of the tray. As best seen in FIG. 4, these flanges are positioned behind the lateral projections 176, 176A on the front wall of the support 104. In this way, the flanges 175, 175A and adjacent projections 176, 176A, respectively, will be forced into "pinching" contact when weight is applied due to articles being placed in the tray. The abutting engagement of the flanges and projections will resist the tendency of the tray to rotate downwardly, assisted by the retention force exerted by spring 120.

Figure 7:
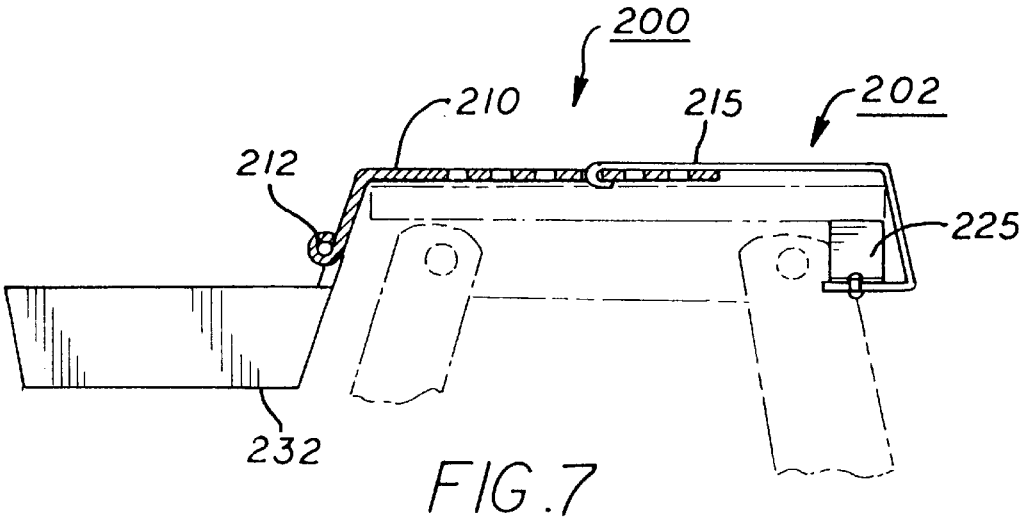
FIG. 7 is a side view of yet another embodiment of the present invention showing the tray of this embodiment secured to the top cap of a ladder.
Figure 8:
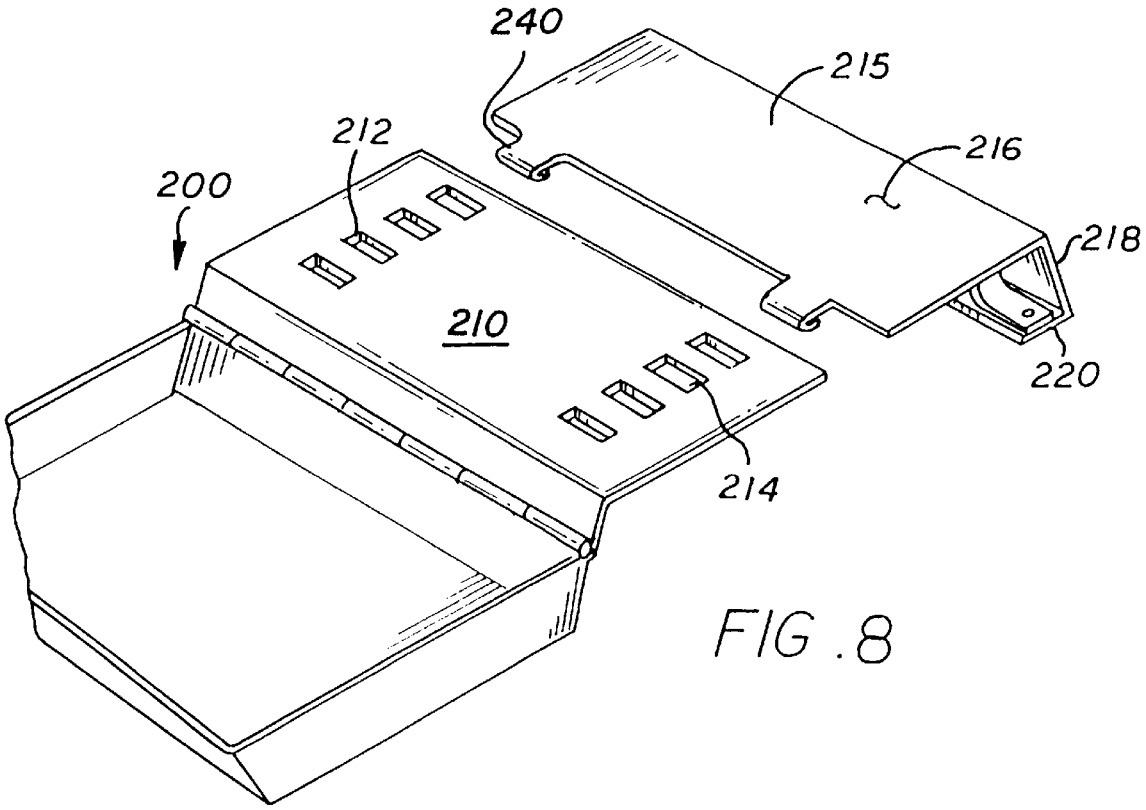
FIG. 8 is an exploded view of the article tray shown in FIG. 7.

FIGS. 7 and 8 illustrate another embodiment of the present invention generally designated by the numeral 200, again having a tray member 232 constructed generally as described above with a hinge section 212 which secures it to support 202. The support 202 consists of a planar section 210 which supports the hinge and which pivotally secures the tray 250 to the section. The support 210 has a plurality of apertures 212 and 214, arranged along opposite edges of the panel. A clamping section 215 has a top wall 216, a depending rear wall 218 and an inwardly extending lip 220 which form a generally C-shaped configuration which are adapted to engage the edge of the top cap. A leaf spring 225 may be interposed within the channel of the C-shaped member to exert a biasing force against the underside of the top cap. The support sections 210 and 215 may be secured at selected locations by engaging hooks 240 in selected of apertures 212 and 214. This allows the support to be transversely adjusted to accommodate ladder top caps of various widths.

Figure 9:
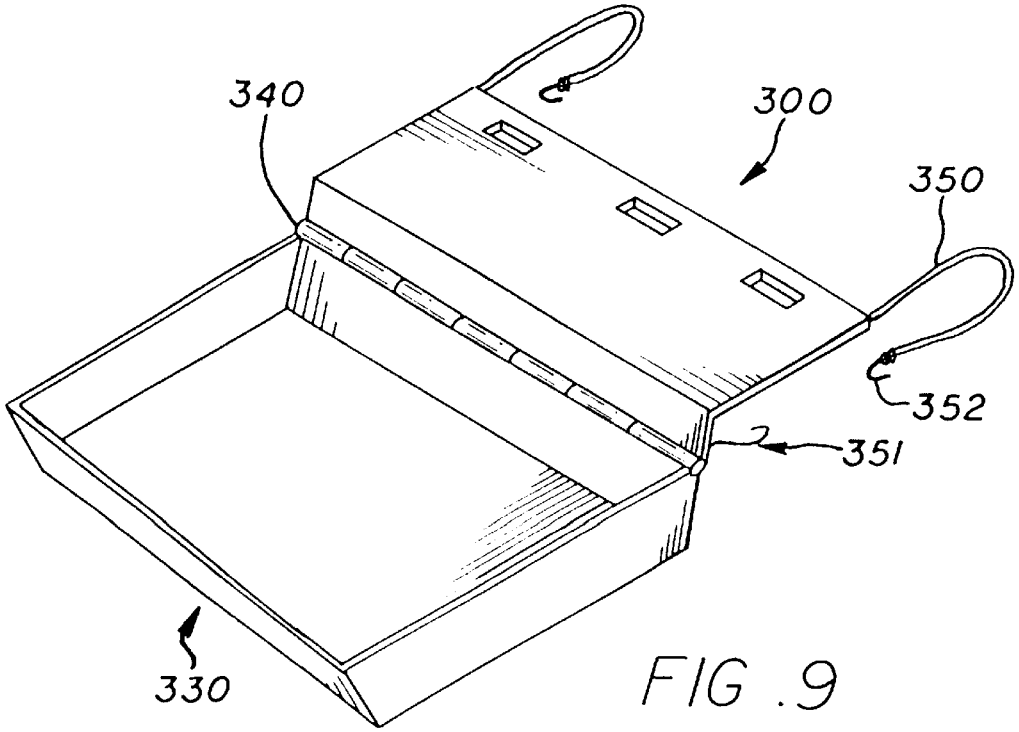
FIG. 9 is a perspective view of yet another embodiment of the present invention.
Figure 10:
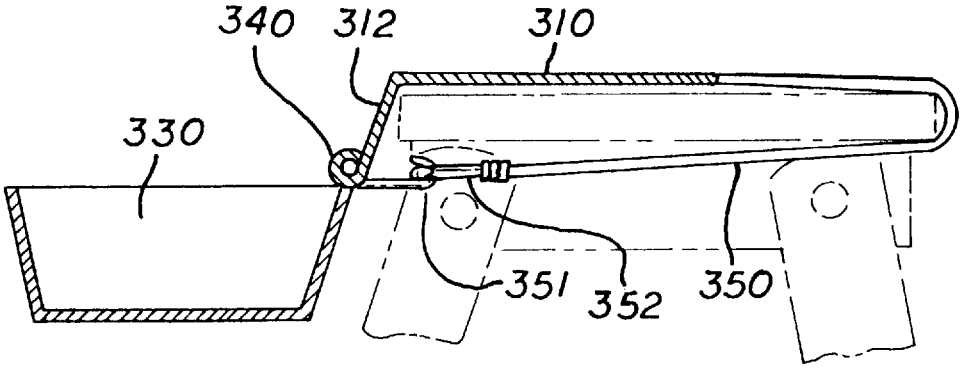
FIG. 10 is a side elevational view showing the embodiment of the article tray of FIG. 9 secured to the top cap of a step ladder.

FIGS. 9 and 10 illustrate yet another embodiment of the present invention which is designated by the numeral 300. This embodiment again includes a tray member 330 of any convenient shape, shown as being generally rectangular, having an outwardly diverging front wall. The rear wall of the tray member is secured by a hinge section 340 to top support 310 The top support 310 has a planar section which overlies the top surface of the top cap of the ladder and a downward depending leg section 312 which carries the hinge section. Retainers or hooks 351 are provided extending or projecting from wall 312 toward the front legs of the ladder. One or more elasticized retainer members 350, such as bungee-type cords, are secured having one end attached to the edge of the support plate 310. The opposite ends of the bungee cords carry hooks 352 which may be engaged in the retainers to secure the support and tray in place.

From the foregoing, it will be seen that the present invention provides a tray which is easily adapted and installed on most conventional step ladders and when mounted on the ladder, provides a convenient article receptacle for tools, various articles such as screws and nails and even paint containers. The device is stable in that the weight of the tray is supported by either abutment against the leg of the ladder or by a support plate which extends substantially across the top of the top cap. The tray may be made of any suitable material such as a rigid plastic or preferably is made from a light-weight metal such as aluminum, suitably stamped and formed. This facilitates manufacture and makes the device convenient to package and nestable for shipping.

In use, the consumer can easily attach the device to the step ladder and remove it as necessary. When installed on the ladder, the tray can be easily deployed by simply pivoting forwardly to the use-position. When the tray is not required to be used, it can be pivoted rearwardly so that it assumes a position overlying the top cap so that it is out of the way. The tray does not interfere with normal use of the ladder since good safety practice prohibits use of the top cap as a stepping surface.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A universal article receiving and storage device for use with a ladder having front legs and rear step supporting legs attached to a generally planar top cap, said device comprising:

(a) a support member having a front edge and a top and having attachment means for detachably securing said support member to the top cap with said top overlying said top cap;

(b) a tray member having a bottom wall and a side wall;

(c) a hinge connecting said front edge of said support member and said tray member side wall whereby said tray member may be deployed in a generally horizontal position extending forwardly from said top cap with said tray member supported at said hinge and by engagement with said ladder front legs and wherein said tray member may be folded to an inverted, stored position overlying said top cap and said top whereby said ladder steps are accessible when said tray member is deployed; and (d) said support member having a rear edge which forms a surface positionable below said top cap and wherein said attachment means comprises biasing means on said surface engageable with said top cap to exert a retaining force on said support member.

2. The article receiving and storage device of claim 1 wherein said tray member is plastic.

3. The article receiving and storage device of claim 1 wherein said tray member is metal.

4. The article receiving and storage device of claim 1 wherein said tray member is formed having recesses therein for containment of articles.

5. The article receiving and storage device of claim 1 wherein said top comprises a panel for extending substantially over the top cap and said panel has tabs engageable with the tray member in a deployed position to resist torque loads to maintain said tray substantially horizontally when deployed.

6. A universal article receiving and storage device for use with a ladder having front legs and rear step supporting legs attached to a generally planar top cap having a width, said device comprising:

(a) a support member having a front edge and a top and having attachment means for detachably securing said support member to the top cap with said top overlying said top cap;

(b) a tray member having a bottom wall and a side wall;

(c) a hinge connecting said support member and said tray member side wall whereby the tray member may be deployed in a generally horizontal position extending forwardly from said top cap with said tray member supported at said hinge and by engagement with said ladder front legs and wherein said tray member may be folded to an inverted, stored position overlying said top cap and said top whereby said ladder steps are accessible when said tray member is deployed; and (d) said support member including a pair of relatively adjustable panels which may be selectively positioned in accordance with the width of the top cap.

* * * * *